United States Patent [19]

Hardes et al.

[11] Patent Number: 4,580,722

[45] Date of Patent: Apr. 8, 1986

[54] FUEL INJECTION NOZZLES

[75] Inventors: Brian J. Hardes, Colchester; Malcolm R. Dunnell, Hadleigh; Roger C. Lloyd, Acton Sudbury, all of England

[73] Assignee: Lucas Industries public limited company, Birmingham, England

[21] Appl. No.: 594,864

[22] Filed: Mar. 29, 1984

[30] Foreign Application Priority Data

Apr. 16, 1983 [GB] United Kingdom ..... 8310349

[51] Int. Cl.[4] ..... F02M 55/00

[52] U.S. Cl. ..... 239/124; 239/533.3

[58] Field of Search ..... 239/533.2–533.12, 239/124

[56] References Cited

U.S. PATENT DOCUMENTS

| | | | |
|---|---|---|---|
| 2,627,254 | 2/1953 | DeJuhasz | 239/533.4 |
| 3,342,422 | 9/1967 | Millington et al. | 239/533.3 |
| 3,948,446 | 4/1976 | Goyal | 239/533.3 |
| 4,275,844 | 6/1981 | Grgurich et al. | 239/533.3 |

*Primary Examiner*—Andres Kashnikow

[57] ABSTRACT

A fuel injection nozzle for supplying fuel to an internal combustion engine includes a nozzle holder which defines a chamber containing a spring which biases a fuel pressure actuated valve member to the closed position. Fuel leaks into the chamber in use and is allowed to escape from the chamber through a passage into a space defined between the holder and a surrounding sleeve. The sleeve carries a boss in which is formed an outlet communicating with the space. Fuel tight seals are provided between the sleeve and the boss.

3 Claims, 2 Drawing Figures

FUEL INJECTION NOZZLES

This invention relates to a fuel injector for supplying fuel to an internal combustion engine, the injector being of the so-called inwardly opening type in which a valve member slidable within a bore in a nozzle body is moved away from a seating defined in the bore, by fuel under pressure against the action of resilient means, the end of the valve member remote from the seating being exposed to a low pressure.

The object of the invention is to provide a fuel injector of the kind specified in a simple and convenient form.

According to the invention a fuel injector of the kind specified comprises a right cylindrical holder, said nozzle body being secured to one end of the holder by a cap nut including a skirt portion which is in screw thread engagement with the holder, a fuel inlet formed at the end of the holder remote from the nozzle body, said fuel inlet being axially disposed and communicating with a fuel supply passage in the body by way of a transfer passage in the holder, a chamber defined in the holder into which fuel leaking along the working clearance defined between the valve member and said bore can collect, a generally radial drilling extending from said chamber to the exterior of the holder, a sleeve surrounding said holder in spaced relationship, axially spaced sealing means located between the holder and said sleeve to define sealed ends to said space, said drilling opening into said space, an outlet carried by said sleeve for connection in use to a drain and a retaining nut in screw thread engagement with the holder said retaining nut engaging one end of the sleeve and acting to retain the other end of the sleeve in engagement with the end of the skirt portion of the cap nut.

An example of a fuel injector in accordance with the invention will now be described with reference to the accompanying drawings in which.

Figure 1:
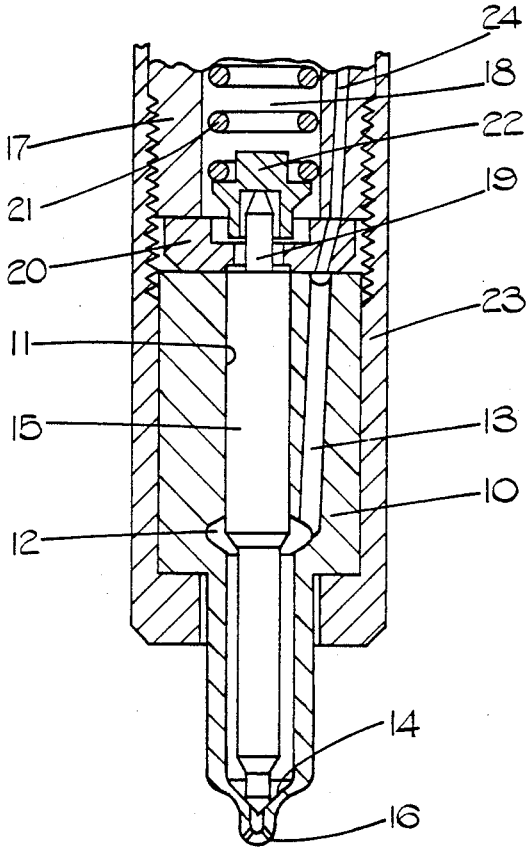
FIG. 1 is a sectional side elevation of a portion of the fuel injector.

Referring to FIG. 1 of the drawings the fuel injector comprises a stepped nozzle body 10, the narrower portion of which extends in use through a bore into a combustion space of the associated engine. Formed in the nozzle body is a bore 11 having intermediate its ends, an enlargement 12 which communicates with a fuel inlet passage 13 extending to the wider end of the body. At the end of the portion of the bore lying within the narrower part of the body there is defined a seating 14 and slidable within the bore is a valve member 15. The portion of the valve member which lies between the enlargement and the seating is of smaller diameter than the remaining portion of the valve member and furthermore, the valve member is shaped for co-operation with the seating 14. Downstream of the seating there is disposed an outlet, this in the particular example, being in the form of a pair of outlet orifices 16.

Figure 2:
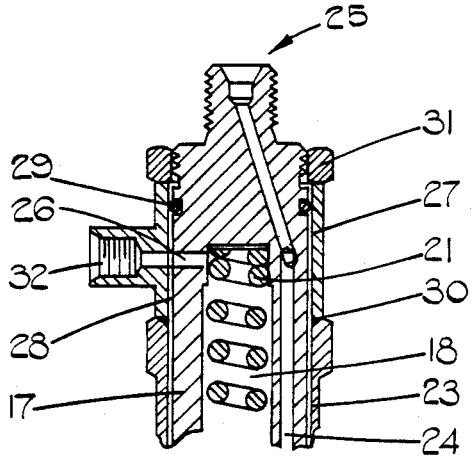
FIG. 2 is a sectional side elevation of the remaining portion of the injector to a slightly smaller scale.

The injector also includes a nozzle holder 17 which is of right cylindrical form and in which is defined a chamber 18 into which a reduced end portion 19 of the valve member 15 extends. Located between the nozzle holder and the nozzle body is a spacer member 20 in which is formed an aperture through which the portion 19 of the valve member extends. Located within the chamber 18 is a coiled compression spring 21 one end of which bears against the end of the chamber as seen in FIG. 2, and the other end of which is located upon a spring abutment 22 carried on the end portion 19 of the valve member.

The nozzle body and nozzle holder with the spacer member therebetween are held in assembled relationship by means of a cap nut 23. The cap nut is of cup-shaped form and is provided with an aperture in its base wall through which the reduced portion of the nozzle body extends. Part of the skirt portion of the nut is provided with a screw thread for engagement with complementary threads formed on the nozzle holder.

The spacer member 20 is provided with a through passage which places the inlet passage 13 in communication with a transfer passage 24 formed in the holder. The passage 24 extends to a fuel inlet 25 the latter being formed at the end of the nozzle holder remote from the body. The inlet in use, is connected to the outlet or an outlet of a high pressure fuel injection pump.

When fuel under pressure is supplied to the inlet, the fuel in the enlargement 12 is pressurised and the fuel pressure acts upon the valve member 15. When the fuel presure is sufficiently high the valve member is lifted from its seating against the action of the spring 21 and fuel flows through the orifices 16. The extent of movement of the valve member is limited by abutment of the main body portion thereof with the spacer 20. As is well known in the art, fuel can leak along the working clearance defined between the wall of the bore 11 and the valve member 15 and this fuel accumulates in the chamber 18. It is necessary to allow the fuel to escape from this chamber otherwise the pressure in the chamber may rise to a sufficient extent as to prevent the valve member opening.

As shown in FIG. 2 a radial drilling 26 is formed in the wall of the holder, the drilling opening onto the exterior surface of the holder. Moreover, surrounding the holder is a sleeve 27 which has an internal diameter slightly larger than that of the holder so as to define a space 28 between the holder and the internal surface of the sleeve. A pair of sealing members are provided to seal the opposite ends of the space and the upper sealing member comprises an O-ring 29 which is located within a groove formed in the wall of the holder. The lower sealing member is defined by a sealing ring 30 which is located within a recess defined by the skirt portion of the cap nut 23 and the holder. The ring 30 forms a seal with the adjacent end of the sleeve 27 and the sleeve is urged towards the cap nut to engage therewith by means of a retaining nut 31 which is in screw thread engagement with the end portion of the holder. The sleeve is also provided with a boss in which is formed a fuel outlet 32.

In use, the fuel which collects in the chamber 18 can pass through the drilling 26 into the space 28 and from this space to the outlet 32. As shown the outlet 32 and the drilling 26 are in alignment. However, it will be appreciated that because of the space 28, the sleeve can be moved angularly prior to tightening of the nut 31, to any desired location convenient for connection to the outlet 32 of a drain pipe.

As an alternative to the boss, the drain pipe may be secured as by brazing for example, to the sleeve.

We claim:

1. A fuel injector for supplying fuel to an internal combustion engine, the injector being of the so-called inwardly opening type in which a valve member slidable within a bore in a nozzle body is moved away from a seating defined in the bore by fuel under pressure against the action of resilient means, the end of the valve member remote from the seating being exposed to a low pressure, the fuel injector comprising a right cylindrical holder, said nozzle body being secured to one end of the holder by a cap nut including a skirt portion which is in screw thread engagement with the holder, a fuel inlet formed at the end of the holder remote from the nozzle body, said fuel inlet being axially disposed and communicating with a fuel supply passage in the body by way of a transfer passage in the holder, a chamber defined in the holder into which fuel leaking along the working clearance defined between the valve member and said bore can collect, a generally radial drilling extending from said chamber to the exterior of the holder, a sleeve surrounding said holder in spaced relationship, axially spaced sealing means located between the holder and said sleeve to define sealed ends to said space, said drilling opening into said space, an outlet carried by said sleeve for connection in use to a drain and a retaining nut in screw thread engagement with the holder said retaining nut engaging one end of the sleeve and acting to retain the other end of the sleeve in engagement with the end of the skirt portion of the cap nut.

2. An injector according to claim 1 in which one of said sealing means comprises an "O" ring located in a groove defined between the holder and the sleeve, the other sealing means comprises a further "O" ring which is located within a recess defined by the skirt portion of the cap nut and the holder, the adjacent end of the sleeve being held in sealing engagement with said further "O" ring.

3. An injector according to claim 1 in which said outlet is defined in a boss on said sleeve.

* * * * *